US008601848B2

(12) United States Patent
Yogo

(10) Patent No.: US 8,601,848 B2
(45) **Date of Patent: *Dec. 10, 2013**

(54) BENDING DEVICE

(75) Inventor: Teruaki Yogo, Aichi (JP)

(73) Assignee: Kabushiki Kaisha Opton, Aichi (JP)

( * ) Notice: Subject to any disclaimer, the term of this patent is extended or adjusted under 35 U.S.C. 154(b) by 158 days.

This patent is subject to a terminal disclaimer.

(21) Appl. No.: 13/258,611

(22) PCT Filed: Apr. 8, 2010

(86) PCT No.: PCT/JP2010/056377

§ 371 (c)(1),
(2), (4) Date: Sep. 22, 2011

(87) PCT Pub. No.: WO2010/117039

PCT Pub. Date: Oct. 14, 2010

(65) Prior Publication Data

US 2012/0016512 A1 Jan. 19, 2012

(30) Foreign Application Priority Data

Apr. 8, 2009 (JP) ..... 2009-094096

(51) Int. Cl.

| | |
|---|---|
| ***B21D 11/00*** | (2006.01) |
| ***B21D 43/10*** | (2006.01) |
| ***B21D 7/04*** | (2006.01) |
| ***B21D 9/05*** | (2006.01) |
| ***B21D 55/00*** | (2006.01) |
| ***B21C 51/00*** | (2006.01) |

(52) U.S. Cl.
USPC ..... 72/307; 72/422; 72/149; 72/20.5; 72/14.8

(58) Field of Classification Search
USPC ..... 72/306, 307, 149, 311, 157, 422, 14.8, 72/17.3, 21.3, 20.3, 20.5
See application file for complete search history.

(56) References Cited

U.S. PATENT DOCUMENTS 3,431,759 A * 3/1969 Whittingham et al. ..... 72/422
4,945,747 A * 8/1990 Yogo ..... 72/306

(Continued)

FOREIGN PATENT DOCUMENTS

JP 5-13733 B2 2/1993
JP 2006-116604 A 5/2006

OTHER PUBLICATIONS

International Preliminary Report on Patentability issued in International Patent Application No. PCT/JP10/056377 on Nov. 24, 2011.

*Primary Examiner* — Dana Ross
*Assistant Examiner* — Mohammad I Yusuf
(74) *Attorney, Agent, or Firm* — Vincent K. Gustafson; Jenkins, Wilson, Taylor & Hunt, P.A.

(57) ABSTRACT

A bending device that bends a workpiece is provided with a bending mechanism that bends the workpiece, a fixing table on which a chuck mechanism that grips the workpiece is mounted, an articulated robot to which the bending mechanism is attached, and a control unit that controls operations of the bending mechanism, the chuck mechanism, and the articulated robot. The control unit includes a first control unit that twists the bending mechanism around a longitudinal axis of the workpiece, and a second control unit that controls the articulated robot to twist the bending mechanism holding the workpiece around the longitudinal axis of the workpiece within a twisting angle range and then causes the first control unit to perform the twisting.

2 Claims, 10 Drawing Sheets

(56) References Cited

U.S. PATENT DOCUMENTS

| | | | | |
|---|---|---|---|---|
| 5,873,278 | A * | 2/1999 | Saegusa | 72/306 |
| 6,185,968 | B1 * | 2/2001 | Kanamori | 72/14.8 |
| 6,189,353 | B1 * | 2/2001 | Kanamori | 72/14.8 |
| 6,237,380 | B1 * | 5/2001 | Kanamori | 72/14.8 |
| 6,694,794 | B2 * | 2/2004 | Crippa | 72/307 |
| 6,854,311 | B2 * | 2/2005 | Schmauder et al. | 72/157 |
| 7,275,406 | B2 * | 10/2007 | Yogo | 72/306 |
| 7,373,797 | B2 * | 5/2008 | Rosenberger | 72/307 |
| 2006/0065034 | A1 | 3/2006 | Yogo | |

* cited by examiner

BENDING DEVICE

CROSS-REFERENCE TO RELATED APPLICATIONS

This application is filed under the provisions of 35 U.S.C. §371 and claims the priority of International Patent Application No. PCT/JP10/056,377 filed on Apr. 8, 2010, and of Japanese Patent Application No. 2009-094096 filed on Apr. 8, 2009. The disclosures of said international patent application and Japanese patent application are hereby incorporated by reference herein in their entireties.

TECHNICAL FIELD

The present invention relates to a bending device which moves a bending mechanism around a longitudinal workpiece, such as a pipe or a bar-like material, to bend the workpiece in a predetermined direction.

BACKGROUND ART

In a bending device disclosed in Patent Document 1, a bending mechanism is attached to an end of an articulated robot. The articulated robot has a plurality of bending joints which rotate around axes parallel to each other, and a plurality of pivoting joints which rotate around axes orthogonal to the parallel axes. Rotation of the respective joints to move the bending mechanism allows a workpiece to be moved toward a chuck mechanism and gripped by the chuck mechanism. Rotation of the respective joints to move the bending mechanism also allows the workpiece to be bent at a plurality of positions.

PRIOR ART DOCUMENT

Patent Document

Patent Document 1: Unexamined Japanese Patent Application Publication No. 2006-116604

DISCLOSURE OF THE INVENTION

Problems to be Solved by the Invention

In the above-described conventional bending device, the bending mechanism is twisted and rotated around a longitudinal axis of the workpiece by the articulated robot upon bending the workpiece, so that a bending direction can be controlled to be a desired direction. On the other hand, in the conventional bending device as above, the bending mechanism cannot be rotated in an overall range of bending directions from 0° to 360°. Thus, arms of the articulated robot interfere with the workpiece.

One object of the present invention is to provide a bending device which can bend a workpiece without limitation of bending directions.

Means to Solve the Problems

One aspect of the present invention provides a bending device that bends a workpiece and includes a bending mechanism, a fixing table, an articulated robot, and a control unit. The bending mechanism includes a bending die and a clamping die which can rotate around the bending die. The bending mechanism clamps a longitudinal workpiece with the bending die and the clamping die, and bends the workpiece by rotating the clamping die. A chuck mechanism that grips the workpiece is mounted on the fixing table. The bending mechanism is attached to the articulated robot. The control unit controls the articulated robot, the bending mechanism and the chuck mechanism. The bending device moves the bending mechanism by the articulated robot, and rotates the clamping die by the bending mechanism to bend the workpiece. The control unit includes a first control unit and a second control unit. The first control unit controls the articulated robot to twist the bending mechanism holding the workpiece around a longitudinal axis of the workpiece, when a twisting angle is within a preset twisting angle range. The second control unit, when the twisting angle exceeds the preset twisting angle range, first controls the articulated robot to twist the bending mechanism holding the workpiece around the longitudinal axis of the workpiece within the preset twisting angle range, and then causes the first control unit to perform the twisting.

A second aspect of the present invention provides the bending device according to the first aspect wherein the articulated robot has a plurality of bending joints which rotate around axes parallel to each other, and a plurality of pivoting joints which rotate around axes orthogonal to the parallel axes.

Effect of the Invention

In the bending device of the present invention, when the twisting angle exceeds the preset twisting range, the articulated robot is controlled to twist the bending mechanism holding the workpiece around the longitudinal axis of the workpiece within the preset twisting angle range. Thereafter, with a change of the holding of the workpiece, the workpiece is twisted within the twisting angle range. Thus, the workpiece can be bent without limitation in its bending direction.

EXPLANATION OF REFERENCE NUMERALS

Figure 1:
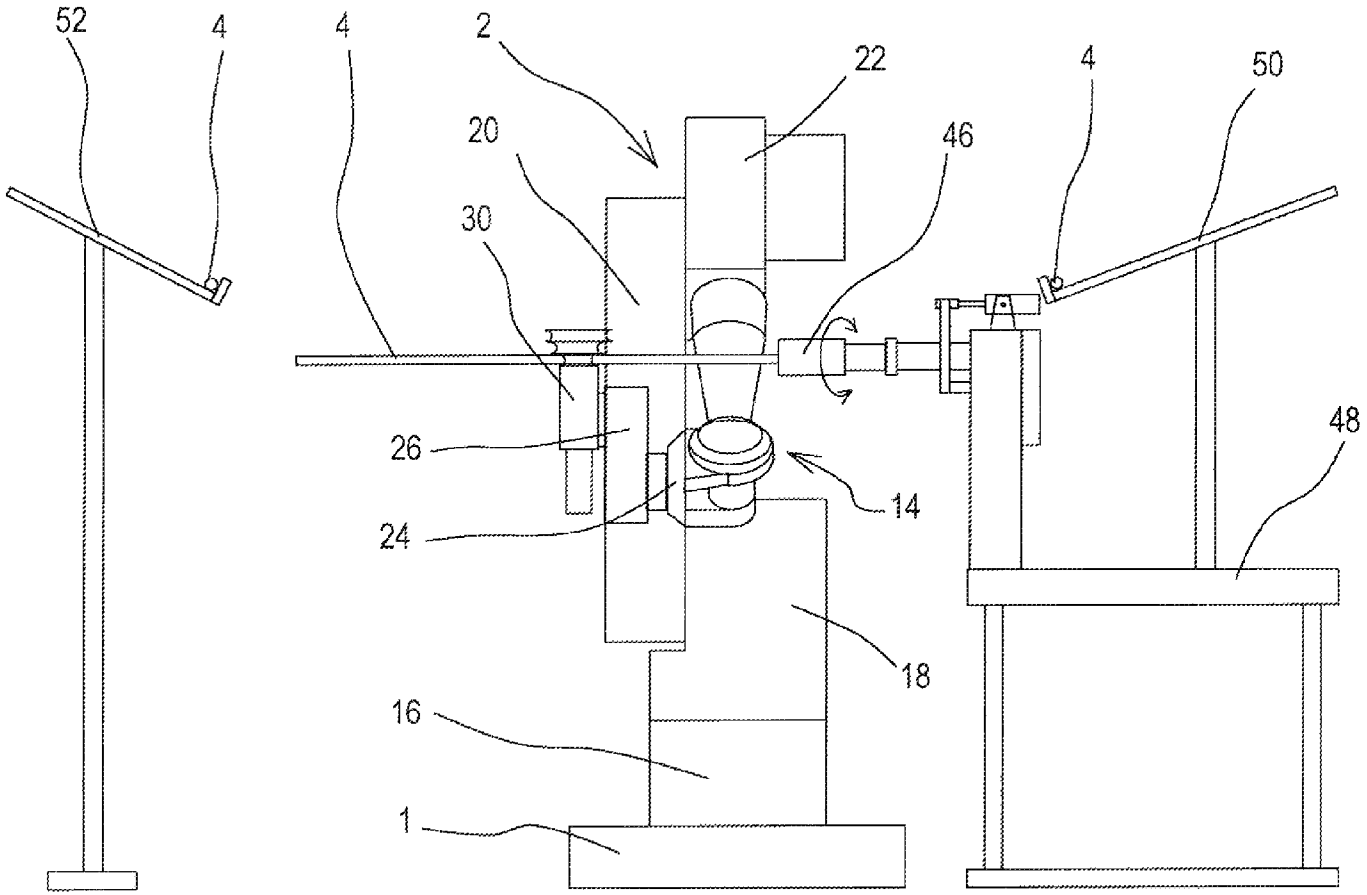
FIG. 1 is a front view of a bending device according to one embodiment of the present invention.
Figure 2:
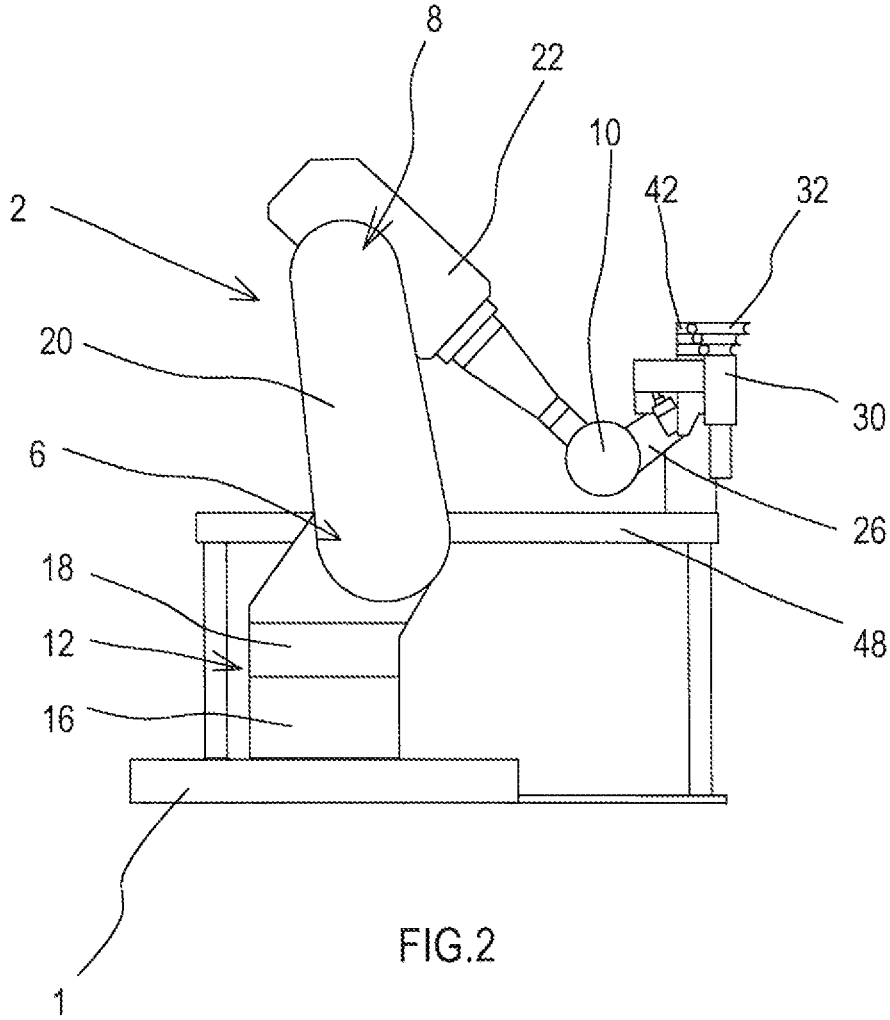
FIG. 2 is a left side view of the bending device according to the embodiment.
Figure 3:
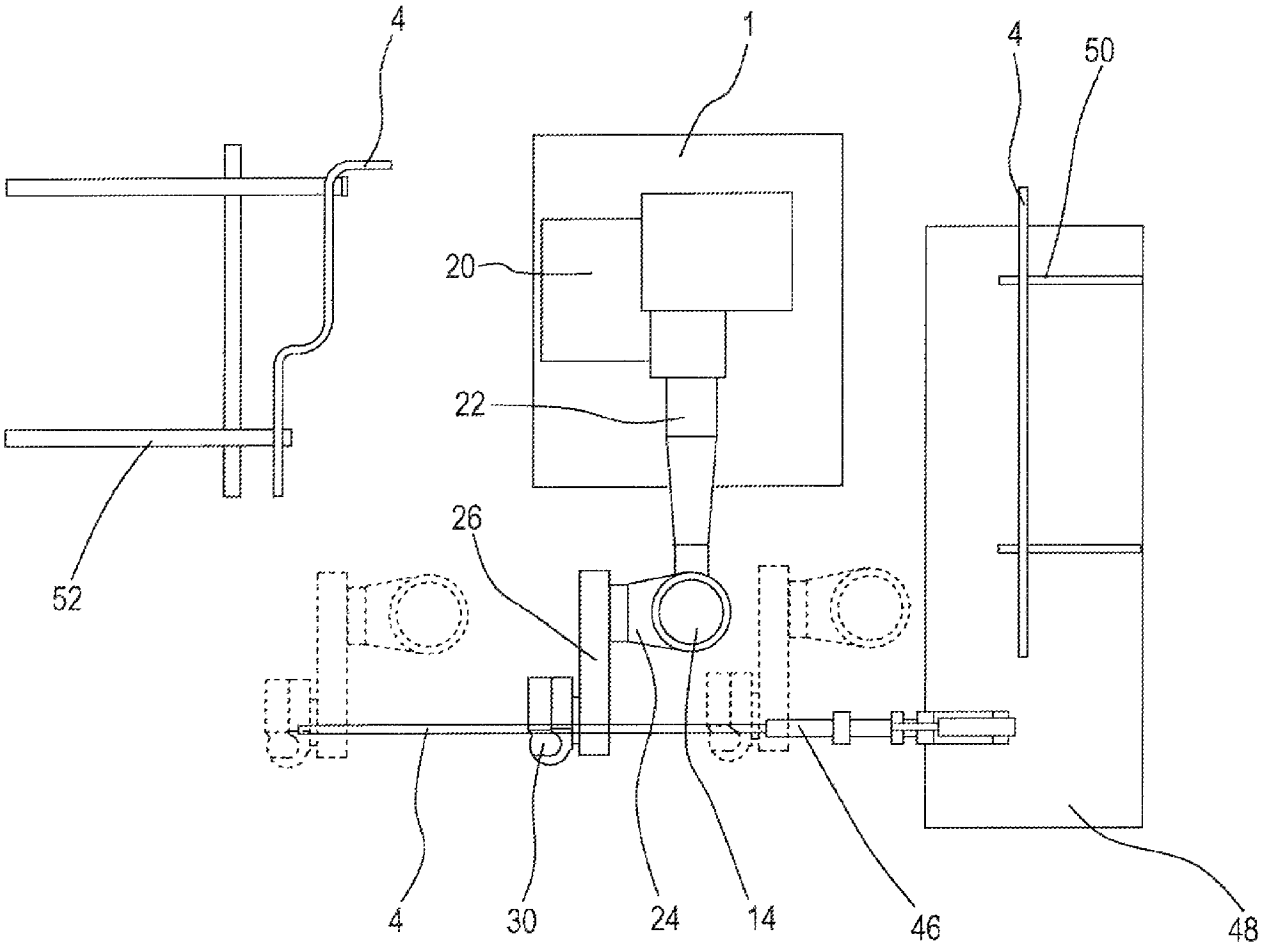
FIG. 3 is a plan view of the bending device according to the embodiment.
Figure 4:
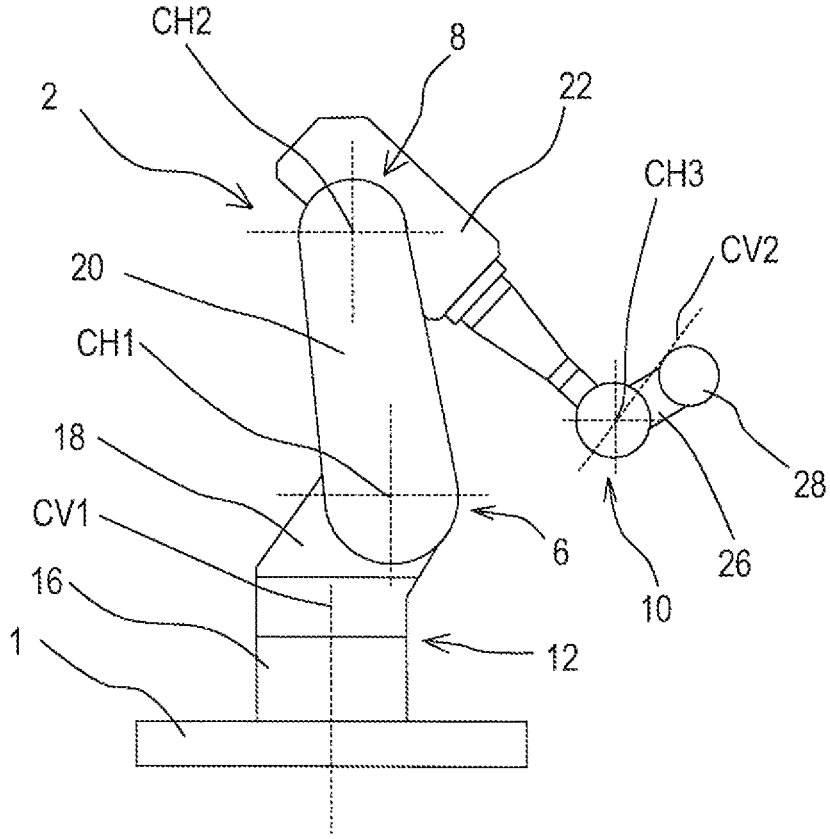
FIG. 4 is a left side view of an articulated robot according to the embodiment.

1 machine . . . base, 2 . . . articulated robot, 4 . . . workpiece, 6,8,10 . . . bending joint, 12,14 . . . pivoting joint, 30 . . . bending mechanism, 32 . . . bending die, 42 . . . clamping die, 44 . . . pressure die, 46 . . . chuck mechanism,

48 . . . fixing table, 50 . . . receiving table for carry-in, 52 . . . receiving table for carry-out, 54 . . . control circuit

BEST MODE FOR CARRYING OUT THE INVENTION

An embodiment of the present invention will now be explained in detail below based on the drawings.

Referring to FIGS. 1 to 4, an articulated robot 2 is mounted on a machine base 1. A later-described bending mechanism 30 that bends a longitudinal workpiece 4 such as a pipe is attached to the articulated robot 2. The articulated robot 2 includes three bending joints, i.e., first to third bending joints 6, 8 and 10, which rotate around axes parallel to each other, and two pivoting joints. i.e., first and second pivoting joints 12 and 14, which rotate around axes orthogonal to the respective parallel axes.

The articulated robot 2 is provided with a fixing portion 16 mounted on the machine base 1. The fixing portion 16 and a first turning base 18 are connected by the first rotating joint 12. The first pivoting joint 12 has a known mechanism that rotationally drives the first turning base 18 at a predetermined angle around a vertical axis CV1.

One end of a first arm 20 is connected to the first turning base 18 via the first bending joint 6. The first bending joint 6 has a known mechanism that rotationally drives the first arm 20 at a predetermined angle around a horizontal axis CH1. The horizontal axis CH1 of the first bending joint 6 and the vertical axis CV1 of the first pivoting joint 12 cross at right angles.

An other end of the first arm 20 and one end of a second arm 22 is connected via the second bending joint 8. The second bending joint 8 has a known mechanism that rotationally drives the second arm 22 at a predetermined angle around an axis CH2 parallel to the horizontal axis CH1 of the first bending joint 6.

A second turning base 24 is connected to an other end of the second arm 22 via the second pivoting joint 14. The second pivoting joint 14 has a known mechanism that rotationally drives the second turning base 24 at a predetermined angle around an axis CV2 orthogonal to the horizontal axes CH1 and CH2 of the first and second bending joints 6 and 8. One end of a front arm 26 is connected to the second turning base 24 via the third bending joint 10. The third bending joint 10 rotates the front arm 26 around an axis CH3 parallel to the horizontal axes CH1 and CH2 of the first and second bending joints 6 and 8.

A supplemental joint 28 (see FIG. 4) is provided at a front end of the front arm 26. The bending mechanism 30 is attached to the supplemental joint 28. The supplemental joint 28 is mechanically synchronized with the third bending joint 10. When the third bending joint 10 rotates the front arm 26 by 360°, the supplemental joint 28 rotates the bending mechanism 30 by 360°. The supplemental joint 28 can be configured to rotate independently of the third bending joint 10.

Figure 5:
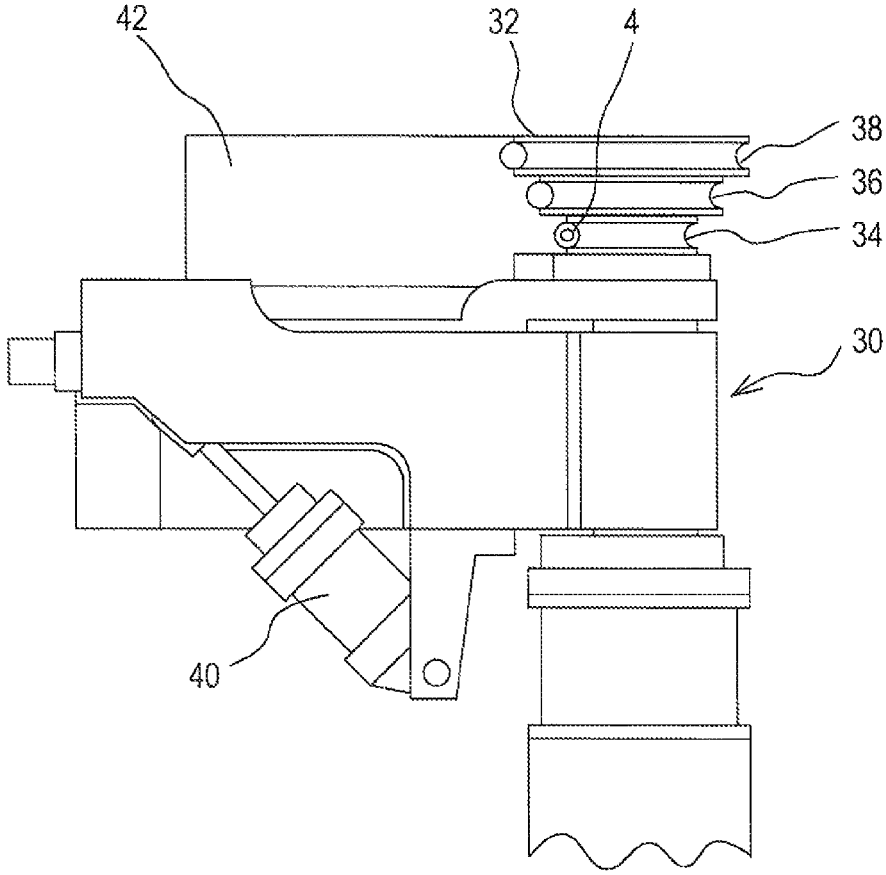
FIG. 5 is an enlarged side view of a bending mechanism according to the embodiment.
Figure 6:
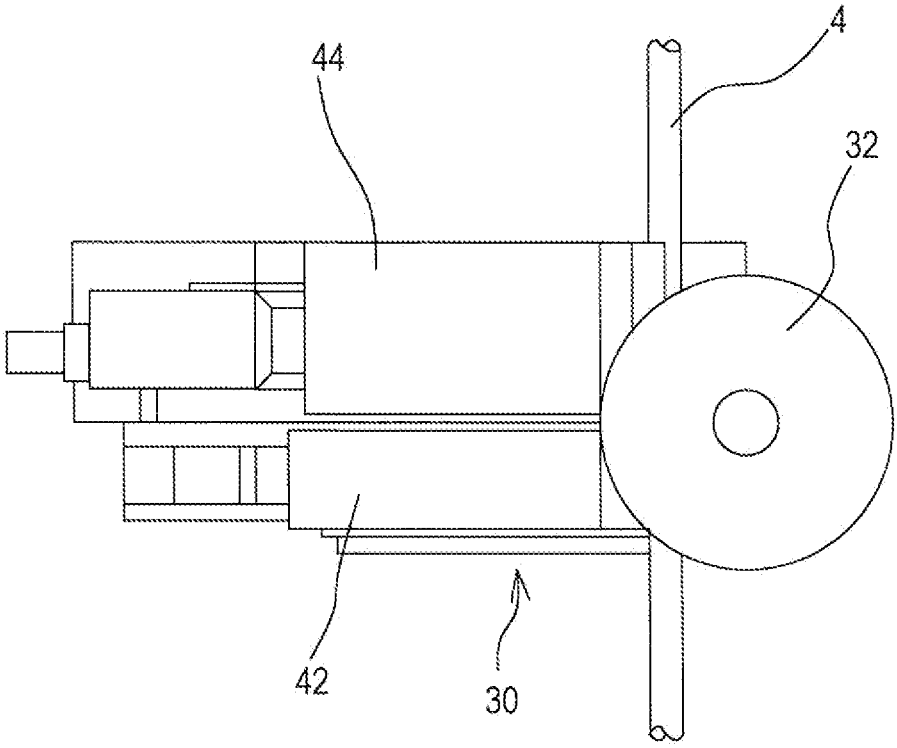
FIG. 6 is an enlarged plan view of the bending mechanism according to the embodiment.

The bending mechanism 30, as shown in FIGS. 5 and 6, includes a bending die 32. The bending die 32 is formed of three grooves 34, 36 and 38. The grooves 34, 36 and 38 are stacked in an axial direction of the bending die 32. The three grooves 34, 36 and 38 correspond to three different bending radii. The bending mechanism 30 also includes a clamping die 42. The clamping die 42 is driven by a cylinder 40 to move toward the bending die 32 and clamps the workpiece 4 together with the bending die 32. The clamping die 42 is configured to be able to move around the bending die 32 with the workpiece 4 being clamped. The bending mechanism 30 is configured to bend the workpiece 4 by rotating the clamping die 42 at a predetermined angle. The bending mechanism 30 is provided with a pressure die 44, in line with the clamping die 42, which receives a reaction force upon bending. Bending is not limited to compression bending but can be draw bending.

As shown in FIG. 1, a chuck mechanism 46 that grips a rear end of the workpiece 4 is provided. The chuck mechanism 46 is attached to the fixing table 48. The workpiece gripped by the chuck mechanism 46 is configured to be in a state horizontal and orthogonal to the vertical axis CV1 of the first pivoting joint 12. Further, on both sides of the articulated robot 2, a receiving table for carry-in 50 and a receiving table for carry-out 52 are respectively provided.

The articulated robot 2 can control a posture and a moving position of the bending mechanism 30, as shown in FIGS. 9A, 9B and 10A to 10E, by rotating the first to third bending joints 6, 8 and 10 and the first and the second pivoting joints 12 and 14.

Figure 9A:
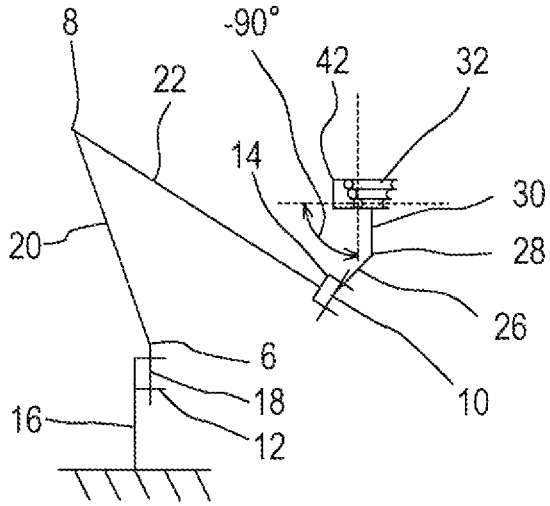
FIGS. 9A and 9B are operation explanatory views from a lateral direction of the articulated robot according to the embodiment.
Figure 9B:
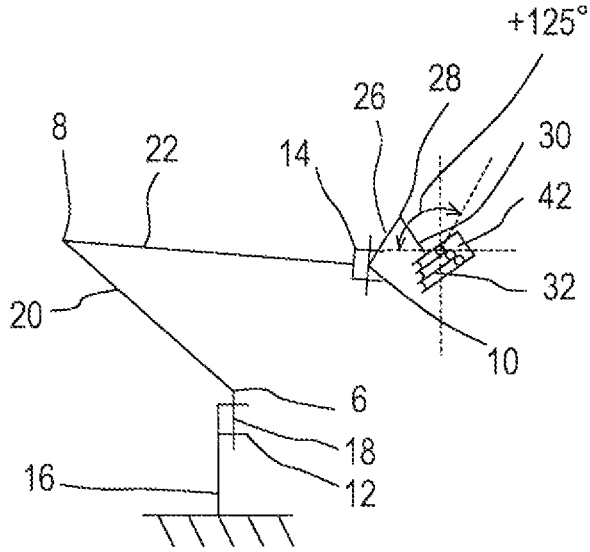

For example, as shown in FIGS. 9A and 9B, the bending mechanism 30 can be moved so that a bending direction of the workpiece 4 coincides with a direction of the groove 34 of the bending die 32 according to the bending direction of the workpiece 4. In the present embodiment, the third bending joint 10 and the supplemental joint 28 are in a certain synchronizing relation. Thus, if the bending direction is defined, positions of the front arm 26 and the third bending joint 10 are defined by causing the groove 34 to abut on the workpiece 4.

A position of the second bending joint 8 is on an arc around the first bending joint 6, of which radius is a distance between the first bending joint 6 and the second bending joint 8. The position of the second bending joint 8 is also on an arc around the third bending joint 10, of which radius is a distance between the second bending joint 8 and the third bending joint 10. Accordingly, if the second bending joint 8 is in an intersection between the two arcs, a position of the bending die 32 is defined. There may be a case in which two intersections exist. In that case, one of the intersections is selected which does not cause the second arm 22 to interfere with the workpiece 4, and which does not cause a front end of the workpiece 4 after bent to interfere with the second arm 22.

In this manner, the positions of the respective first to third bending joints 6, 8 and 10 are defined. As a result, an angle formed between the fixing portion 16 and the first arm 20, an angle formed between the first arm 20 and the second arm 22, and an angle formed between the second arm 22 and the front end arm 26 are respectively calculated. According to the respective angles calculated, the first arm 20, the second arm 22 and the front arm 26 are rotated at predetermined angles by the respective first to third bending joints 6, 8 and 10. Thereby, the groove 34 of the bending die 32 is moved to abut on the workpiece 4.

On the other hand, as shown in FIG. 9A, in order to change the bending direction of the workpiece 4 from the horizontal direction, the first to third bending joints 6, 8 and 10 of the articulated robot 2 are driven to rotate the bending mechanism 30 around the longitudinal axis of the workpiece 4. Assuming that the rotation in a counterclockwise direction shown in FIG. 9A is a − (minus) direction, one of the arms 20, 22 and 26 of the articulated robot 2 interferes with the workpiece 4 if the rotation exceeds −90 degrees.

Also, as shown in FIG. 9B, in order to change the bending direction, the first to third bending joints 6, 8 and 10 of the articulated robot 2 are driven to rotate the bending mechanism 30 around the longitudinal axis of the workpiece 4. Assuming that the rotation in a clockwise direction shown in FIG. 9B is a + (plus) direction, one of the arms 20, 22 and 26 of the articulated robot 2 interferes with the workpiece 4 if the rotation exceeds +125 degrees.

Figure 10A:
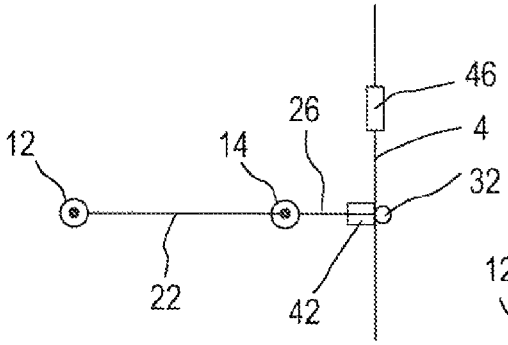
FIGS. 10A to 10E are operation explanatory views from a planar direction of the articulated robot according to the embodiment.

As shown in FIG. 10A, when the first arm 20, the second arm 22 and the front arm 26 of the articulated robot 2 are within a plane orthogonal to the workpiece 4, the first to third bending joints 6, 8 and 10 can be rotated and the bending mechanism 30 can be moved around the workpiece 4 so that the bending direction is set to a predetermined direction, as shown in FIGS. 9A and 9B.

Figure 10B:
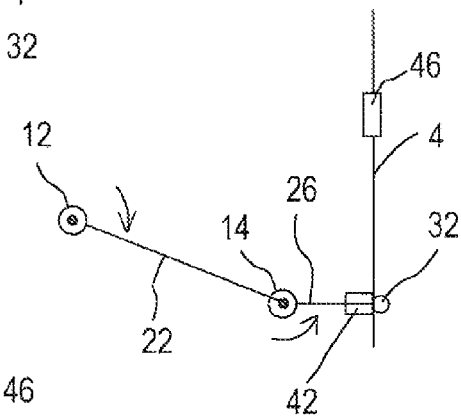

As shown in FIG. 10B when the bending position is on the front end side of the workpiece 4, the first pivoting joint 12 is driven and the second pivoting joint 14 is driven to the side opposite to the first pivoting joint 12 to drive the first to third bending joints 6, 8 and 10 so that an axial direction of the front arm 26 is orthogonal to the workpiece 4. When the first pivoting joint 12 is rotated, the bending mechanism 30 is moved away from the workpiece 4. Thus, the first to third bending joints 6, 8 and 10 are driven to make the groove 34 of the bending die 32 abut on, the workpiece 4. A bending shape can be changed by making the other grooves 36 and 38 abut on the workpiece 4.

Figure 10C:
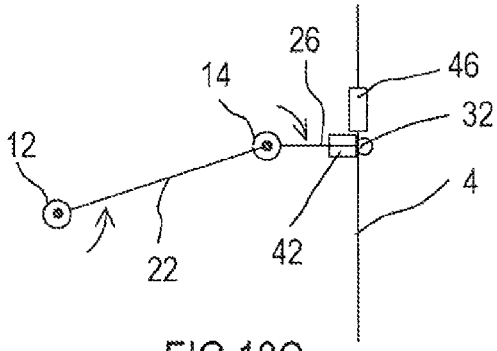

As shown in FIG. 10C, also in the case of bending the workpiece 4 at the bending position close to the chuck mechanism 46, the first pivoting joint 12 is driven to more the bending mechanism 30 to the bending position. In this case, the bending mechanism 30 is moved such that the second pivoting joint 14 is driven to the side opposite to the first pivoting joint 12, so that an axial direction of the front arm 26 is orthogonal to the workpiece 4. Also the first to third bending joints 6, 8 and 10 are driven.

When bending is performed at a plurality of positions, the aforementioned operation is repeated from the bending position at the front end side of the workpiece 4 toward the bending position close to the chuck mechanism 46 to sequentially bend the workpiece 4, as shown in FIG. 10B.

Figure 7:
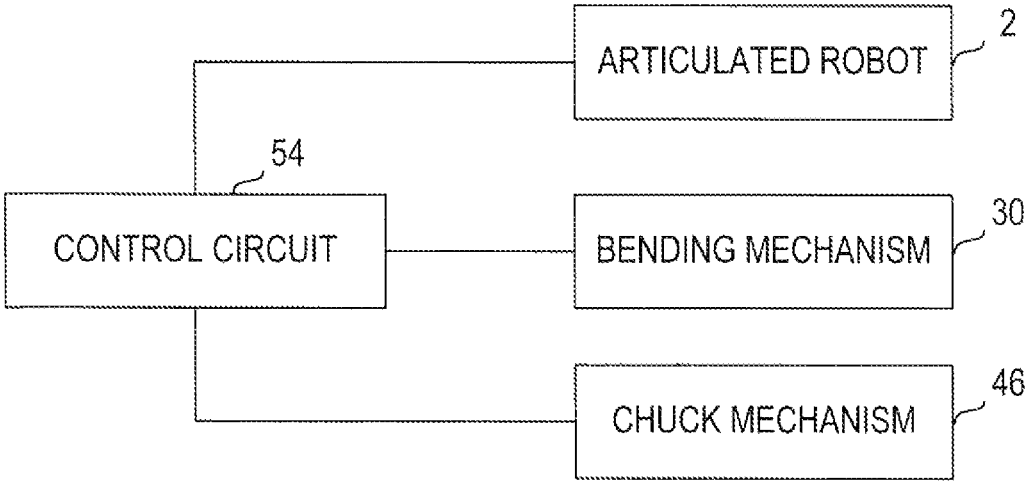
FIG. 7 is a block diagram showing a control system of the bending device according to the embodiment.

The articulated robot 2, the bending mechanism 30, and the chuck mechanism 46 are connected to the control circuit 54, as shown in FIG. 7. The control circuit 54 controls driving of the articulated robot 2, the bending mechanism 30, and the chuck mechanism 46, respectively.

Figure 8:
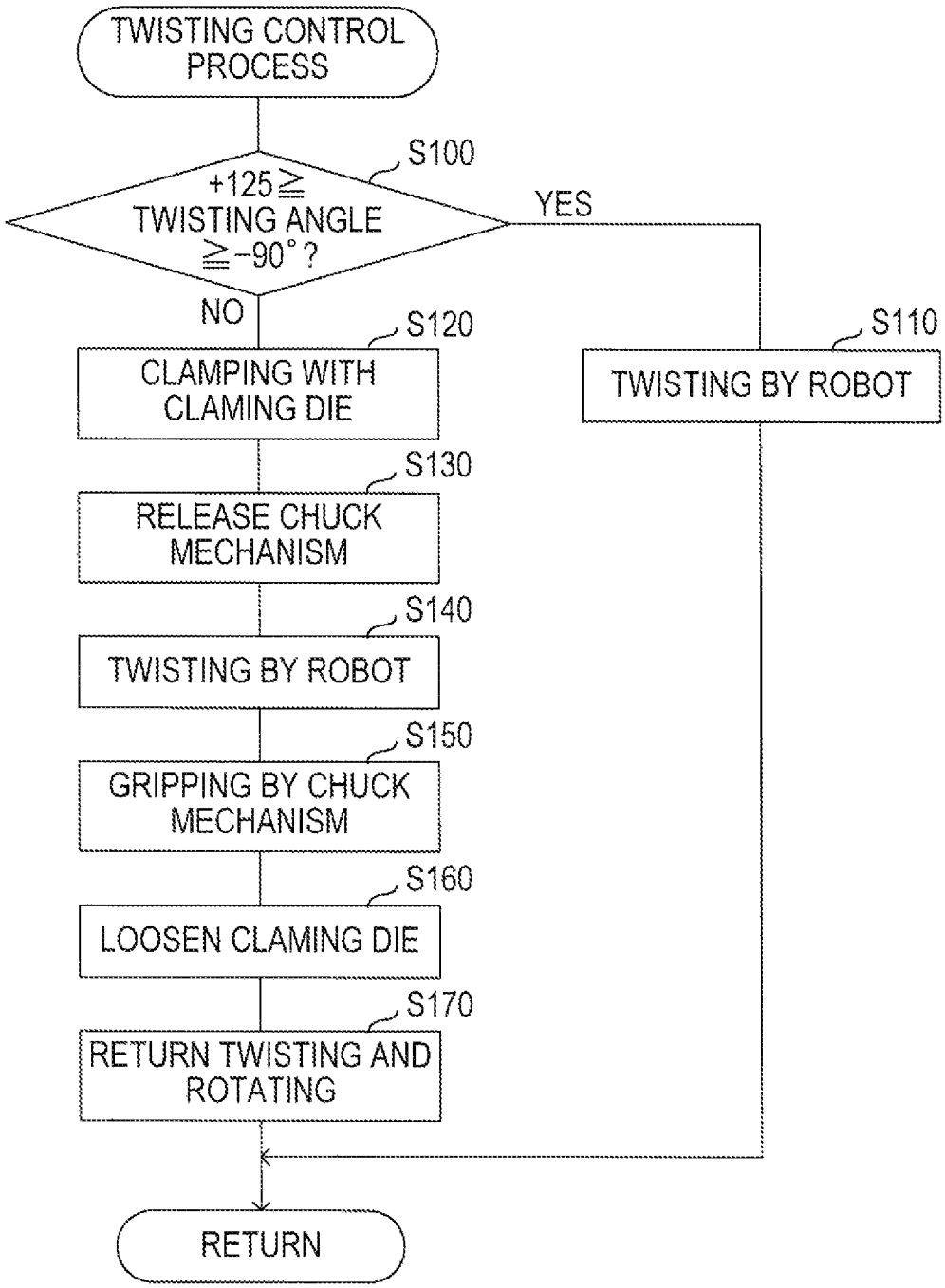
FIG. 8 is a flowchart showing an example of a twist control process executed in a control circuit according to the embodiment.

Now, operation of the aforementioned bending device of the present embodiment will be described by way of the flowchart shown in FIG. 8, together with a twisting control process performed in the control circuit 54.

Figure 10D:
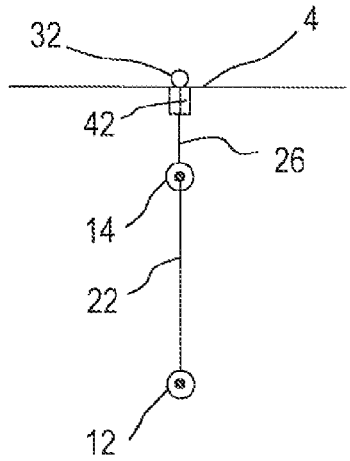
Figure 10E:
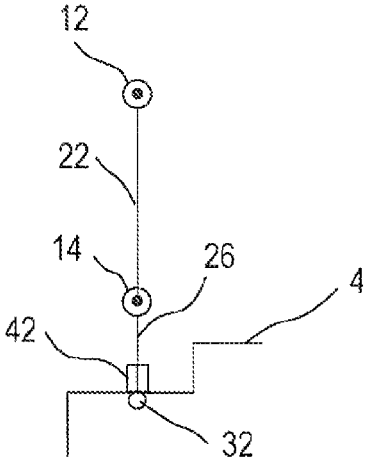

First, the workpiece 4 which has been cut into a predetermined length is conveyed onto the receiving table for carrying-in 50. As shown in FIG. 10D, the first pivoting joint 12 of the articulated robot 2 is driven so that the articulated robot 2 faces the workpiece 4 on the receiving table for carry-in 50. Also, the first to third bending joints 6, 8 and 10 of the articulated robot 2 are driven to move the bending mechanism 30 so that the workpiece 4 abuts on the groove 34 of the bending die 32.

Next, the clamping die 42 is moved to clamp the workpiece 4 by the bending mechanism 30. After the workpiece 4 is clamped by the bending mechanism 30, the articulated robot 2 is controlled to drive the respective first to third bending joints 6, 8 and 10 and first and second pivoting joints 12 and 14 to move the workpiece 4 to the chuck mechanism 46, as shown in FIG. 10A.

The workpiece 4 on the receiving table for carry-in 50 is moved toward the chuck mechanism 46 so that the workpiece 4 can be gripped by the chuck mechanism 46. After the workpiece 4 is moved to the chuck mechanism 46 and inserted to the chuck mechanism 46, the chuck mechanism 46 is controlled to grip the workpiece 4.

According to preset bending data, the articulated robot 2 is controlled to move the bending mechanism 30 to the bending position of the workpiece 4. If there are a plurality of portions to be bent, bending is started from the front end side of the workpiece 4. After the bending mechanism 30 is move to the bending position of the workpiece 4, the clamping die 42 and the pressure die 44 are driven to abut on the workpiece 4. The clamping die 42 is moved around the pressure die 44 according to a predetermined bending angle.

After the bending, the clamping die 42 and the pressure die 44 are returned to their original positions. If the next bending is to be performed, the articulated robot 2 is controlled to move the bending mechanism 30 to the next bending position, and bend the workpiece 4 by the bending mechanism 30.

If the bending direction is to be changed, a twisting control process is executed. Upon changing the bending direction, the clamping die 42 is moved to clamp the workpiece 4 by the bending mechanism 30. The bending mechanism 30 can be then twisted and rotated around the longitudinal axis of the workpiece 4 so as to twist the workpiece 4.

In the twisting control process, it is at first determined whether or not a twisting angle which changes the bending direction is within a preset twisting angle range (step 100). In the present embodiment, as shown in FIGS. 9A and 9B, if the bending mechanism 30 is twisted and rotated around the longitudinal axis of the workpiece 4 in the twisting range of +125 to −90 degrees, one of the arms 20, 22 and 26 of the articulated robot 2 interferes with the workpiece 4.

If the twisting angle is within the twisting angle range, the articulated robot 2 is controlled to drive the respective first to three bending joints 6, 8 and 10 to twist and rotate the bending mechanism 30 holding the workpiece 4 around the longitudinal axis of the workpiece 4 (step 110). Then, the present control process is ended. As mentioned above, the workpiece 4 is bent by the bending mechanism 30 at the preset angle in the preset bending direction.

On the other hand, if it is determined in step 100 that the twisting angle exceeds the twisting angle range, the articulated robot 2 is controlled to move the clamping die 42 so that the workpiece 4 abuts on the groove 34 of the bending die 32. The workpiece 4 is clamped with the clamping die 42 and the bending die 32 so that the workpiece 4 is held by the bending mechanism 30 (step 120).

Next, gripping of the workpiece 4 by the chuck mechanism 46 is released (step 130). The articulated robot 2 is controlled to drive the respective first to third bending joints 6, 8 and 10 to twist and rotate the bending mechanism 30 holding the workpiece 4 around the longitudinal axis of the workpiece 4 (step 140). The twisting angle may be half the required twisting angle. Or the twisting angle may be prestored as processing data, and the twist and rotation may be carried out at the prestored twisting angle.

After the workpiece 4 is twisted and rotated by the articulated robot 2, the chuck mechanism 46 is controlled to grip the workpiece 4 (step 150). Next, the clamping die 42 is moved away from the bending die 32 to loosen the clamping of the workpiece 4 by the clamping die 42 and the bending die 32 (step 160).

Thereafter, the articulated robot 2 is controlled to drive the respective first to three bending joints 6, 8 and 10, so that only the bending mechanism 30 is twisted and rotated around the longitudinal axis of the workpiece 4 at the same twisting angle in a reverse direction of the twist and rotation direction in the previous step 140 to return the bending mechanism 30 to the original posture (step 17).

By repetitively executing the present control process, it is determined in step 100 that the twisting angle is within the twisting angle range of +125 to −90 degrees. In step 110, the articulated robot 2 is controlled to drive the respective first to three bending joints 6, 8 and 10, so that the bending mechanism 30 holding the workpiece 4 is twisted and rotated around the longitudinal axis of the workpiece 4. The twisting angle in this case is an angle obtained by subtracting the twisting angle in the aforementioned step 140 from the twisting angle associated with the required bending direction. Then, the present control process is ended. As noted in the above, the workpiece 4 is bent by the bending mechanism 30 at the preset bending angle in the preset bending direction.

In this manner, when the twisting angle exceeds the twisting angle range, the articulated robot 2 is controlled so that the bending mechanism 30 holding the workpiece 4 is twisted around the longitudinal axis of the workpiece 4. Then, the clamping by the bending mechanism 30 is released. The bending mechanism 30 is twisted around the longitudinal axis of the workpiece, and the workpiece 4 is clamped again by the bending mechanism 30 to be twisted around the longitudinal axis. Thus, even if the twisting angle associated with the bending direction exceeds the twisting angle range by repetitive twists within the twisting angle range, the workpiece can be bent without limitation of the bending direction.

The present invention should not be limited to the above described embodiment, and can be practiced in various forms within the scope not departing from the gist of the present invention.

The invention claimed is:

1. A bending device that bends a longitudinal workpiece, the bending device comprising:

a bending mechanism that includes a bending die and a clamping die which rotates around the bending die, the bending mechanism clamping the workpiece with the bending die and the clamping die, and bending the workpiece by rotating the clamping die while twisting the workpiece at a predetermined twisting angle around a longitudinal axis of the workpiece;

a fixing table on which a chuck mechanism that grips the workpiece is mounted;

an articulated robot to which the bending mechanism is attached; and a control unit that controls the articulated robot, the bending mechanism and the chuck mechanism, wherein the control unit includes (i) a determination unit that determines whether or not the twisting angle is within a preset twisting angle range, (ii) a first control unit that controls the articulated robot to twist the bending mechanism holding the workpiece around a longitudinal axis of the workpiece when the determination unit determines that the twisting angle is within the preset twisting angle range, and (iii) a second control unit that, when the determination unit determines that the twisting angle exceeds the preset twisting angle range, controls the articulated robot to twist the bending mechanism holding the workpiece around the longitudinal axis of the workpiece within the preset twisting angle range, and then controls the chuck mechanism and the bending mechanism to repeat an operation of releasing and again clamping the workpiece, and further twisting the workpiece within the preset twisting angle range, to thereby twist the workpiece by the twisting angle.

2. The bending device according to claim 1, wherein the articulated robot has a plurality of bending joints which rotate around axes parallel to each other, and a plurality of pivoting joints which rotate around axes orthogonal to the parallel axes.

* * * * *